US011158255B2

(12) United States Patent
Han et al.

(10) Patent No.: US 11,158,255 B2
(45) Date of Patent: Oct. 26, 2021

(54) DISPLAY DRIVING METHOD, DISPLAY DRIVING DEVICE, AND DISPLAY DEVICE

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Hasieerdun Han, Beijing (CN); Chichang Liu, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 100 days.

(21) Appl. No.: 16/632,927

(22) PCT Filed: Jan. 21, 2019

(86) PCT No.: PCT/CN2019/072551
§ 371 (c)(1),
(2) Date: Jan. 22, 2020

(87) PCT Pub. No.: WO2020/150866
PCT Pub. Date: Jul. 30, 2020

(65) Prior Publication Data
US 2021/0225281 A1 Jul. 22, 2021

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2330/021* (2013.01)

(58) Field of Classification Search
CPC ..... G09G 3/3233; G09G 3/3266; G09G 2330/021
See application file for complete search history.

(56) References Cited

U.S. PATENT DOCUMENTS

2004/0164938 A1 8/2004 Choi et al.
2008/0170014 A1 7/2008 Jung et al.
(Continued)

FOREIGN PATENT DOCUMENTS

CN 1523548 A 8/2004
CN 101794551 A 8/2010
(Continued)

*Primary Examiner* — Stacy Khoo
(74) *Attorney, Agent, or Firm* — Leason Ellis LLP

(57) ABSTRACT

A display driving method, a display driving device, and a display device are provided. The display driving method includes: providing a first voltage, which is lower than a first reference voltage, to a first voltage terminal of a pixel circuit to drive the pixel circuit, wherein a voltage reduction amplitude of the first voltage relative to the first reference voltage is a first amplitude; and providing a second voltage, which is lower than a second reference voltage, to a second voltage terminal of a source driving circuit to control the source driving circuit to generate a data signal which is lower than a data reference voltage, and to provide the data signal to the pixel circuit, a voltage reduction amplitude of the data signal relative to the data reference voltage is the first amplitude.

20 Claims, 8 Drawing Sheets

(56) References Cited

U.S. PATENT DOCUMENTS

| | | | | |
|---|---|---|---|---|
| 2009/0284515 | A1* | 11/2009 | Tsuge | G09G 3/3233 345/211 |
| 2016/0379560 | A1 | 12/2016 | Cho | |
| 2018/0190185 | A1 | 7/2018 | Ko et al. | |

FOREIGN PATENT DOCUMENTS

| | | | |
|---|---|---|---|
| CN | 103021335 | A | 4/2013 |
| CN | 104898409 | A | 9/2015 |
| CN | 105208225 | A | 12/2015 |
| CN | 105259746 | A | 1/2016 |
| CN | 105590955 | A | 5/2016 |
| CN | 105679236 | A | 6/2016 |
| CN | 106297673 | A | 1/2017 |

* cited by examiner

DISPLAY DRIVING METHOD, DISPLAY DRIVING DEVICE, AND DISPLAY DEVICE

CROSS-REFERENCE TO RELATED PATENT APPLICATIONS

This application is a U.S. National Stage Application under 35 U.S.C. § 371 of International Patent Application No. PCT/CN2019/072551, filed Jan. 21, 2019, which is incorporated by reference in its entirety.

TECHNICAL FIELD

Embodiments of the present disclosure relate to a display driving method, a display driving device, and a display device.

BACKGROUND

With the development of display technology, wearable intelligent devices have been widely used in people's daily life due to its portability, high practicality, and other advantages. At present, the wearable intelligent devices of a display market have various shapes and types, and for example, includes products, such as smart glasses, smart watches, smart bracelets, mind controls, healthy wearings, somatosensory controls, article trackings, etc. In addition, the wearable intelligent devices have further been widely used in various fields, such as medical care, navigation, social networks, business, and media, etc., and can bring more convenience to people's future life through the application of different scenarios.

SUMMARY

At least one embodiment of the present disclosure provides a display driving method, which includes: providing a first voltage, which is lower than a first reference voltage, to a first voltage terminal of a pixel circuit to drive the pixel circuit, wherein a voltage reduction amplitude of the first voltage relative to the first reference voltage is a first amplitude; and providing a second voltage, which is lower than a second reference voltage, to a second voltage terminal of a source driving circuit to control the source driving circuit to generate a data signal which is lower than a data reference voltage, and to provide the data signal to the pixel circuit, wherein a voltage reduction amplitude of the data signal relative to the data reference voltage is the first amplitude.

For example, in the display driving method provided by an embodiment of the present disclosure, providing the second voltage, which is lower than the second reference voltage, to the second voltage terminal of the source driving circuit, includes: generating the second voltage by a boosting circuit of a power management circuit, and supplying the second voltage to the source driving circuit, wherein a boosting ratio of the boosting circuit is lower than a reference ratio.

For example, in the display driving method provided by an embodiment of the present disclosure, the boosting ratio is 1 to 1.5.

For example, in the display driving method provided by an embodiment of the present disclosure, the second voltage is equal to an input voltage of the power management circuit.

For example, in the display driving method provided by an embodiment of the present disclosure, providing the second voltage, which is lower than the second reference voltage, to the second voltage terminal of the source driving circuit, includes: switching a voltage received by the second voltage terminal of the source driving circuit to an input voltage, which serves as the second voltage, provided by an input voltage terminal of a power management circuit.

For example, the display driving method provided by an embodiment of the present disclosure, further includes: generating, by the power management circuit, a third voltage which is lower than a third reference voltage, and supplying the third voltage to a gate driving circuit; and generating a scanning signal, which is lower than a scanning reference voltage, by the gate driving circuit, according to the third voltage, and supplying the scanning signal to the pixel circuit.

For example, in the display driving method provided by an embodiment of the present disclosure, the pixel circuit includes a driving sub-circuit, a data writing sub-circuit, a compensation sub-circuit, a first light-emitting control sub-circuit, a second light-emitting control sub-circuit, and a light-emitting element; the driving sub-circuit includes a control terminal, a first terminal, and a second terminal, and is configured to control a driving current, which flows through the first terminal and the second terminal and drives the light-emitting element to emit light; the data writing sub-circuit is connected to the first terminal of the driving sub-circuit, and is configured to write the data signal which is lower than a data reference voltage to the first terminal of the driving sub-circuit in response to a scanning signal; the compensation sub-circuit is connected to the control terminal of the driving sub-circuit, the second terminal of the driving sub-circuit, and the first voltage terminal, and is configured to store the data signal written by the data writing sub-circuit, and to compensate the driving sub-circuit in response to the scanning signal; the first light-emitting control sub-circuit is connected to the second terminal of the driving sub-circuit and the first voltage terminal, and is configured to apply the first voltage, which is lower than a first reference voltage received by the first voltage terminal, to the second terminal of the driving sub-circuit in response to a light-emitting control signal; a second light-emitting control sub-circuit is connected to the first terminal of the driving sub-circuit and a first terminal of the light-emitting element, and is configured to apply the driving current to the light-emitting element in response to the light-emitting control signal; and the light-emitting element includes the first terminal and a second terminal, the first terminal of the light-emitting element is configured to receive the driving current, and the second terminal of the light-emitting element is connected to a fourth voltage terminal to receive a fourth voltage.

For example, in the display driving method provided by an embodiment of the present disclosure, providing the first voltage, which is lower than the first reference voltage, to the first voltage terminal of the pixel circuit to drive the pixel circuit includes a data writing and compensation phase and a light-emitting phase; win the data writing and compensation phase, the scanning signal and the data signal is inputted to turn on the data writing sub-circuit, the driving sub-circuit, and the compensation sub-circuit, the data writing sub-circuit writes the data signal into the driving sub-circuit, the compensation sub-circuit stores the data signal, and the compensation sub-circuit compensates the driving sub-circuit; and in the light-emitting phase, the light-emitting control signal is inputted to turn on the first light-emitting control sub-circuit, the second light-emitting control sub-circuit, and the driving sub-circuit, the first light-emitting control sub-circuit applies the first voltage to the second terminal of the driving sub-circuit, and the second light-emitting control sub-circuit applies the driving current to the light-emitting element to drive the light-emitting element to emit light.

For example, in the display driving method provided by an embodiment of the present disclosure, the pixel circuit further includes a reset sub-circuit; and the reset sub-circuit is connected to a reset voltage terminal, the control terminal of the driving sub-circuit, and the first terminal of the light-emitting element, and is configured to apply a reset voltage to the control terminal of the driving sub-circuit and the first terminal of the light-emitting element in response to a reset signal.

For example, in the display driving method provided by an embodiment of the present disclosure, providing the first voltage, which is lower than the first reference voltage, to the first voltage terminal of the pixel circuit to drive the pixel circuit further includes an initialization phase; and in the initialization phase, the reset signal is inputted to turn on the reset sub-circuit, and the reset voltage is applied to the control terminal of the driving sub-circuit and the first terminal of the light-emitting element.

At least one embodiment of the present disclosure further provides a display driving device, which includes: a first voltage control circuit, configured to provide a first voltage, which is lower than a first reference voltage, to a first voltage terminal of a pixel circuit to drive the pixel circuit, wherein a voltage reduction amplitude of the first voltage relative to the first reference voltage is a first amplitude; and a second voltage control circuit, configured to provide a second voltage, which is lower than a second reference voltage, to a second voltage terminal of a source driving circuit to control the source driving circuit to generate a data signal which is lower than a data reference voltage, and to provide the data signal to the pixel circuit, wherein a voltage reduction amplitude of the data signal relative to the data reference voltage is the first amplitude.

For example, in the display driving device provided by an embodiment of the present disclosure, the second voltage control circuit includes a power management circuit; the power management circuit includes a boosting circuit, and is configured to generate the second voltage by the boosting circuit, and to supply the second voltage to the source driving circuit; and a boosting ratio of the boosting circuit is lower than a reference ratio.

For example, in the display driving device provided by an embodiment of the present disclosure, the second voltage control circuit includes a switching circuit; and the switching circuit is configured to switch a voltage received by a second voltage terminal of the source driving circuit to an input voltage, which serves as the second voltage, provided by an input voltage terminal of a power management circuit.

For example, in the display driving device provided by an embodiment of the present disclosure, the power management circuit is further configured to generate a third voltage which is lower than a third reference voltage, and supply the third voltage to a gate driving circuit; and the gate driving circuit is configured to generate a scanning signal, which is lower than a scanning reference voltage, according to the third voltage, and to supply the scanning signal to the pixel circuit.

At least one embodiment of the present disclosure further provides a display device, which includes the display driving device provided by any one of the embodiments of the present disclosure.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
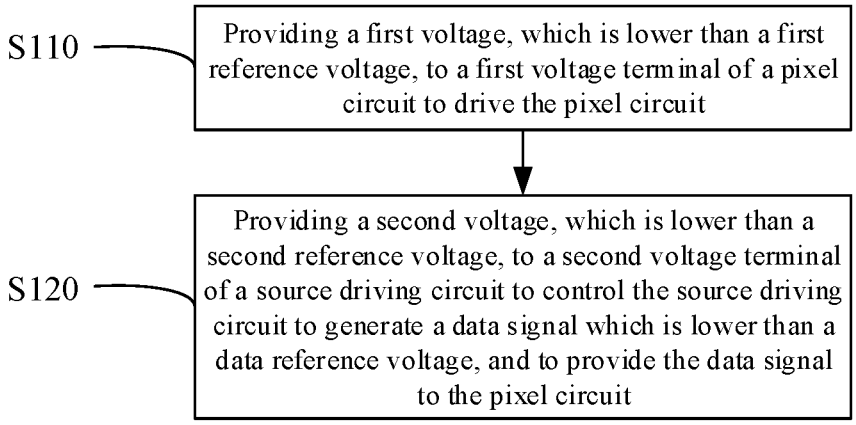
FIG. 1 is a flowchart diagram of a display driving method provided by some embodiments of the present disclosure.

In order to make the objects, technical schemes and advantages of the present disclosure more clear, the technical scheme of the embodiments of the present disclosure will be clearly and completely describe in conjunction with the accompanying drawings of the embodiments of the present disclosure. Obviously, described embodiments are part of the embodiments of the present disclosure, not all of the embodiments. Based on the described embodiments of the present disclosure, all of other embodiments acquired by those skilled in the art without the need for creative work are fall within the scope of the protection of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The present disclosure will be described below by several specific embodiments. In order to keep the following description of embodiments of the present disclosure clear and concise, detailed descriptions of known functions and known components may be omitted. In a case where any one of the components of the embodiments of the present disclosure appears in more than one of the accompany drawings, the component is denoted by the same or similar reference number in respective accompany drawings.

A manufacturing process and a driving method of a display screen of the wearable intelligent devices are similar to those of smart phones. For example, a wearable intelligent device including a processor and an appropriate operating system may consume as much power as a smart phone. However, due to a volume limitation of the wearable intelligent device, a built-in battery capacity of the wearable intelligent device is much lower than a built-in battery capacity of larger display devices, such as smart phones. Therefore, how to reduce the power consumption of the wearable intelligent device has become an urgent problem to be solved on a development path of the wearable intelligent device. Moreover, because the energy consumption of the wearable intelligent devices is mainly on the screen and CPU, manufacturers focus on the screen, and expect to save more power consumption on the screen.

An embodiment of the present disclosure provides a display driving method, which includes: providing a first voltage, which is lower than a first reference voltage, to a first voltage terminal of a pixel circuit to drive the pixel circuit; a voltage reduction amplitude of the first voltage relative to the first reference voltage is a first amplitude; and providing a second voltage, which is lower than a second reference voltage, to a second voltage terminal of a source driving circuit to control the source driving circuit to generate a data signal which is lower than a data reference voltage, and to provide the data signal to the pixel circuit; a voltage reduction amplitude of the data signal relative to the data reference voltage is the first amplitude.

At least one embodiment of the present disclosure further provides a display driving device corresponding to the display driving method, which is mentioned above, and a display device.

The display driving method provided by the above embodiments of the present disclosure can reduce a driving load of the display device, improve a supply electricity efficiency of a power management circuit in the display device, reduce display power consumption of the display device, and improve display quality of the display device, and thus improve market competitiveness of the display device.

Embodiments of the present disclosure and examples thereof will be described in detail below with reference to the accompanying drawings.

FIG. 1 is a flowchart diagram of a display driving method provided by some embodiments of the present disclosure. The display driving method can be implemented in forms of hardware, firmware and any combination thereof, and is configured to reduce a voltage supplied to a pixel circuit and a source driving circuit during a process of driving a display device to implement a display operation so as to simultaneously reduce the voltage and a data signal, which are inputted to the pixel circuit, thereby reducing the power consumption of the display device and improving the display quality of the display device, under condition of not affecting the display performance of the display device.

For example, the display device may be a wearable intelligent device (for example, a smart watch, a smart bracelet, etc.), a smart phone, a notebook computer, a virtual reality device (for example, a virtual reality helmet), an augmented reality device (for example, an augmented reality glass), a desktop computer, a web server, a digital camera, etc. The following description is described by taking a case that the display device is the wearable intelligent device as an example, but the embodiments of the present disclosure are not limited thereto.

Under normal conditions, due to a high driving current of the display device, such as, a smart phone, etc., with a large display screen, a data signal, of which a voltage amplitude is larger than a voltage amplitude of the wearable smart device, is required by the display device with the large display screen. For example, an input voltage received by an input terminal of a power management circuit is VCI. Generally, the power management circuit is required to generate an output voltage (for example, a second reference voltage), which is of 2 to 3 times as large as VCI, by a charge pump. For example, the output voltage can be used as an input voltage of a gamma circuit (Gamma) in a smart phone display device, and as an input voltage (for example, a second reference voltage) of the source driving circuit.

For example, the power management circuit of the smart phone display device usually outputs the second reference voltage (2 to 3 times as large as VCI), which serves as the input voltage of the source driving circuit to ensure the data signal with larger voltage amplitude. However, for the wearable intelligent device, the driving current required by the pixel circuit included in the wearable intelligent device is small, therefore, the voltage amplitude of the data signal required by the wearable intelligent device is further small. Because the wearable intelligent device directly inherits display driving settings (for example, a reference ratio of the power management circuit and a boosting circuit, etc.), which is mentioned above, of the smart phone, the voltage amplitude of the data signal, which is generated, is still relatively large. Therefore, the display screen of the wearable intelligent device is at a disadvantage of a small size and high power consumption. Therefore, for example, in a case where a small-sized display device inherits the driving settings of a large-sized display device, the power consumption of the small-sized display device can be reduced by the display driving method provided by some embodiments of the present disclosure.

Hereinafter, the display driving method provided by some embodiments of the present disclosure will be described with reference to FIG. 1. As shown in FIG. 1, the display driving method includes step S110 to step S120.

Step S110: providing a first voltage, which is lower than a first reference voltage, to a first voltage terminal of a pixel circuit to drive the pixel circuit.

Step S120: providing a second voltage, which is lower than a second reference voltage, to a second voltage terminal of a source driving circuit to control the source driving circuit to generate a data signal, which is lower than a data reference voltage, and to provide the data signal to the pixel circuit.

For example, a voltage reduction amplitude of the first voltage relative to the first reference voltage is a first amplitude. A voltage reduction amplitude of the data signal relative to the data reference voltage is the first amplitude.

Figure 3:
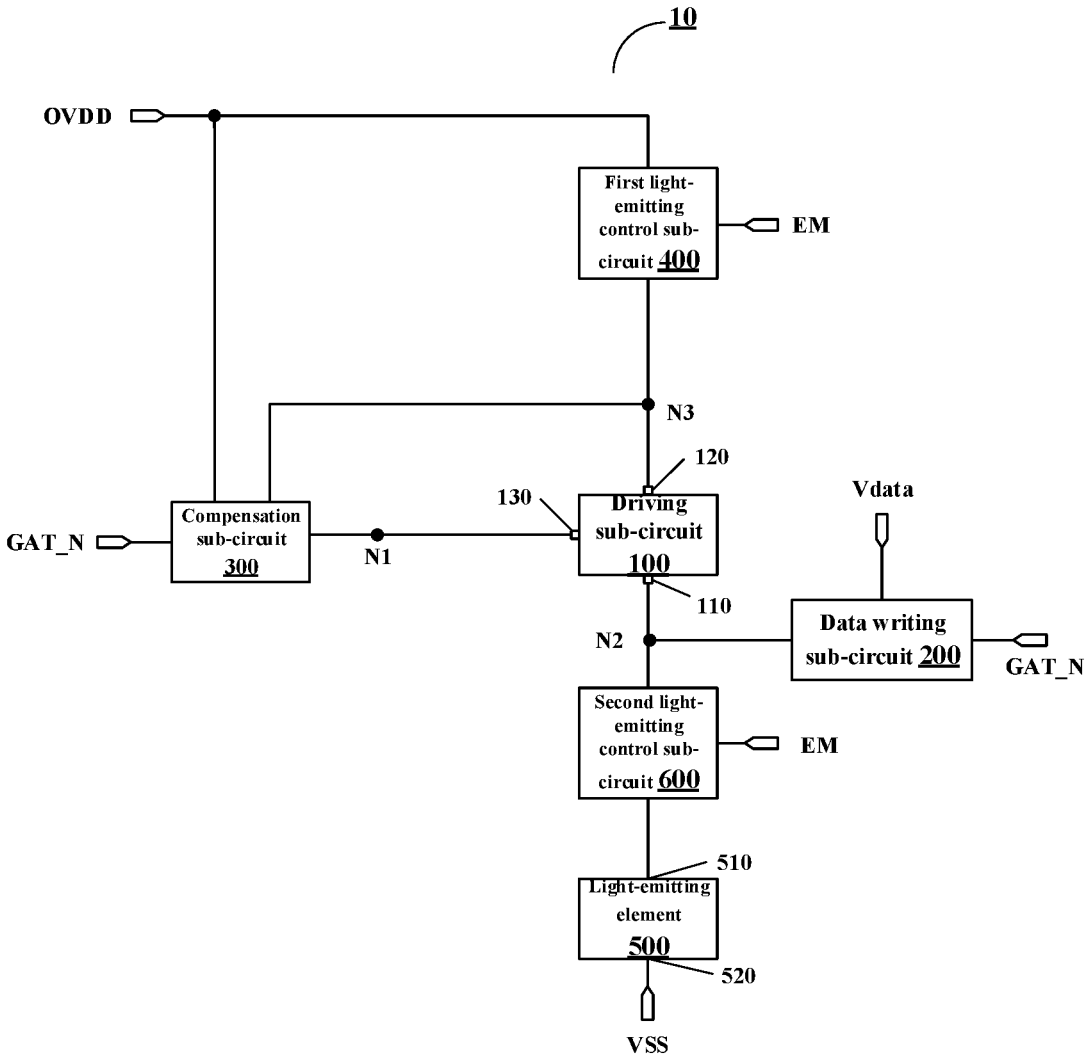
FIG. 3 is a schematic block diagram of a pixel circuit provided by some embodiments of the present disclosure.
Figure 4:
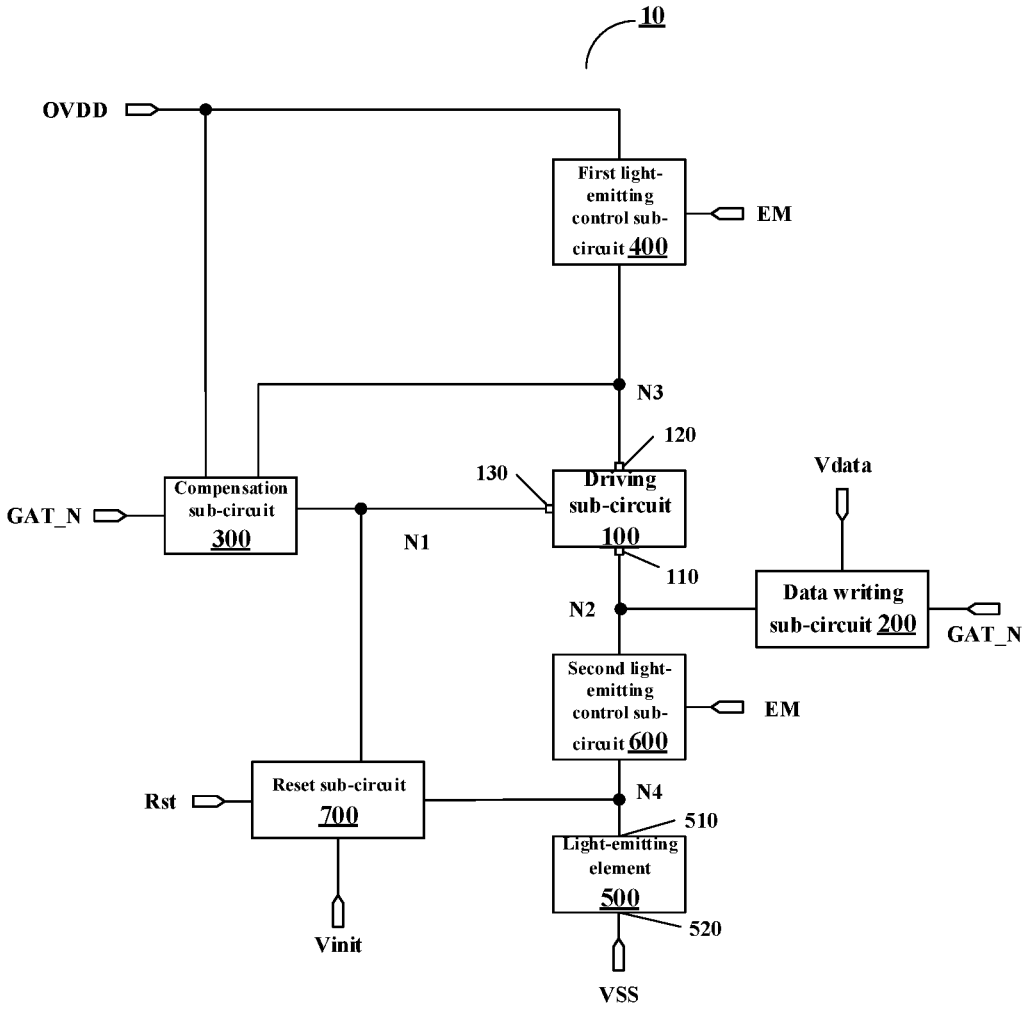
FIG. 4 is a schematic block diagram of another pixel circuit provided by some embodiments of the present disclosure.
Figure 5:
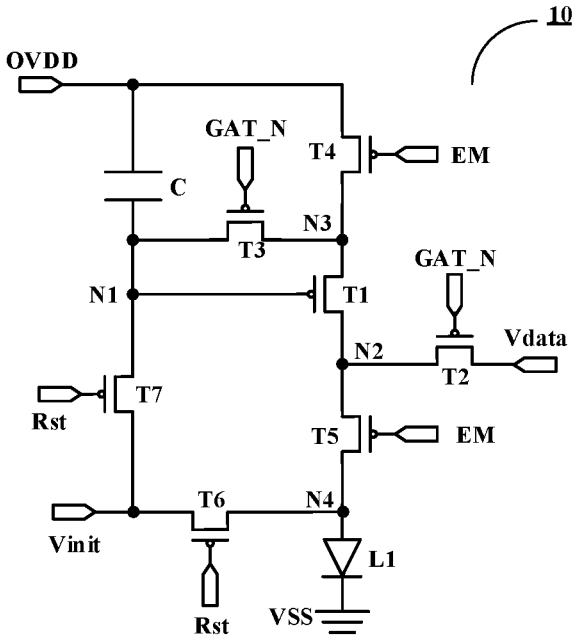
FIG. 5 is a circuit diagram of a specific implementation example of the pixel circuit as shown in FIG. 4.
Figure 11:
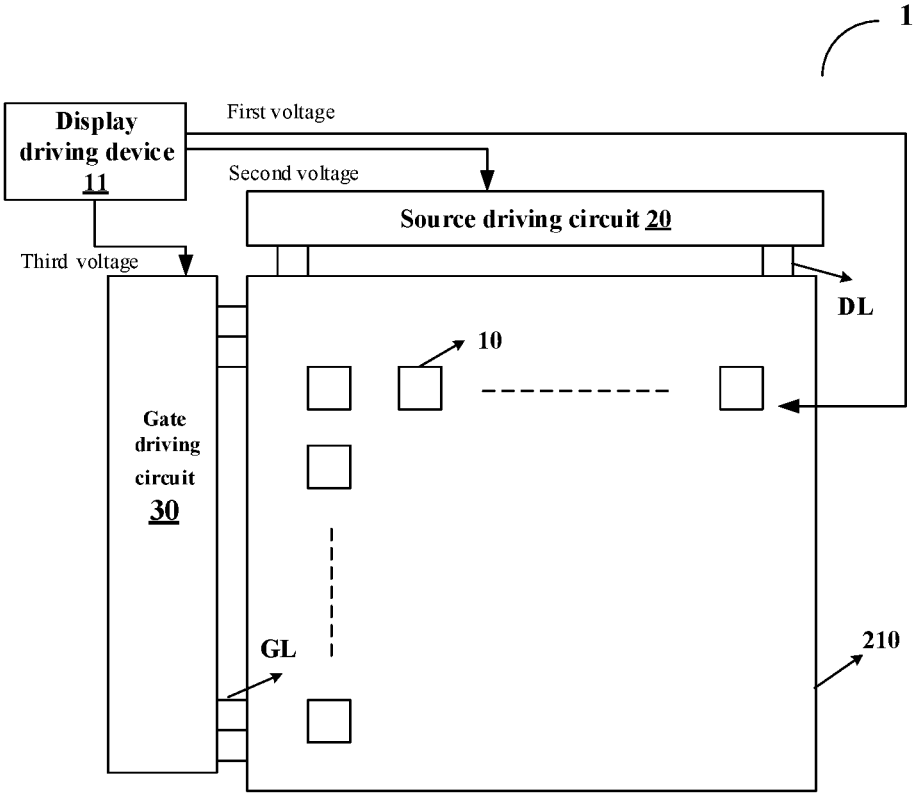
FIG. 11 is a schematic diagram of a display device provided by some embodiments of the present disclosure.

For example, the first voltage is supplied to a first voltage terminal VDD of the pixel circuit of a pixel unit of the display device, as shown in any one of FIG. 3 to FIG. 5, to flow the driving current from the first voltage terminal OVDD to a light-emitting element L1 under control of a driving transistor T1. The second voltage is supplied to the source driving circuit 20 as shown in FIG. 11, and the source driving circuit 20 generates a data signal according to the second voltage, which is received. The data signal is inputted to a data signal terminal Vdata of the pixel circuit as shown in any one of FIG. 3 to FIG. 5 by a data line. The specific description of the first voltage and the data signal of the pixel circuit will be described in detail in FIG. 3 to FIG. 5, and will not be repeated here again. It should be noted that the pixel circuit is not limited to circuit structures as shown in FIG. 3 to FIG. 5, but may further be, for example, circuit structures of 4T1C (for, four transistors and one capacitor), 4T2C, 8T2C, etc., and may have a compensation function, a reset function, a light-emitting control function, etc. The embodiments of the present disclosure are not limited thereto.

For example, the second reference voltage is supplied to the source driving circuit, and the source driving circuit can output the data reference voltage to the data signal terminal Vdata of the pixel circuit as shown in FIG. 5 according to the second reference voltage. Because the data reference voltage is required to correspond to the first reference voltage, and the data reference voltage is controlled by the second reference voltage, the second reference voltage is required to correspond to the first reference voltage. Therefore, the driving load of the power management circuit (for example, the circuit providing the second reference voltage) can be reduced, by reducing a magnitude of the first reference voltage (for example, obtaining the first voltage), and correspondingly reducing a magnitude of the second reference voltage (for example, obtaining the second voltage), thus reducing the display power consumption of the display panel.

For example, for the wearable intelligent device, under normal conditions, the first reference voltage, the second reference voltage, and the data reference voltage are voltages set to satisfy a normal operation of the display device, and specific values may be determined according to actual conditions, and the embodiments of the present disclosure are not limited to this case. For example, in a case where the pixel circuit is driven to work by the first reference voltage and the data reference voltage, the power consumption of entire display device is high. Therefore, the pixel circuit can be driven to work by the first voltage, which is lower than the first reference voltage, and the data signal, which is lower than the data reference voltage, to reduce the power consumption of the display device. The specific working process will be described in detail below and will not be described here again.

FIG. 3 is a schematic block diagram of an exemplary pixel circuit provided by some embodiments of the present disclosure. The exemplary pixel circuit is configured, for example, for the pixel unit (a sub-pixel) in a pixel array of an OLED (Organic Light-Emitting Diode) display device or PLED (Quantum Dot Light-Emitting Diode). The pixel array includes a plurality of rows and columns of pixel units. As shown in FIG. 3, the pixel circuit 10 includes a driving sub-circuit 100, a data writing sub-circuit 200, a compensation sub-circuit 300, a first light-emitting control sub-circuit 400, a second light-emitting control sub-circuit 600, and a light-emitting element 500. The light-emitting element 500 may be the OLED or the PLED.

For example, the driving sub-circuit 100 includes a first terminal 110, a second terminal 120, and a control terminal 130, the driving sub-circuit 100 is configured to control a driving current, which is configured to drive the light-emitting element 500, the control terminal 130 of the driving sub-circuit 100 is connected to a first node N1, the first terminal 110 of the driving sub-circuit 100 is connected to a second node N2, and the second terminal 120 of the driving sub-circuit 100 is connected to a third node N3. For example, in a light-emitting phase, the driving sub-circuit 100 may supply the driving current to the light-emitting element 500 to drive the light-emitting element 500 to emit light, and the light-emitting element 500 can emit light according to a required "gray scale". For example, the light emitting-element 500 may adopt the OLED, and is configured to be connected to the second node N2 by the second light-emitting control sub-circuit 600, and to be connected to a fourth voltage terminal VSS for example, which provides a low level, and for example, which is grounded.

For example, the data writing sub-circuit 200 is connected to the first terminal 110 (the second node N2) of the driving sub-circuit 100, and is configured to write the data signal, which is lower than the data reference voltage, to the first terminal 110 of the driving sub-circuit 100 in response to a scanning signal. For example, the data writing sub-circuit 200 is connected to the data line (a data signal terminal Vdata) in a column in which the pixel unit is located, the second node N2, and a scanning line (a scanning signal terminal GAT_N) in a row in which the pixel unit is located. For example, the scanning signal provided by the scanning signal terminal GAT_N is applied to the data writing sub-circuit 200 to control whether the data writing sub-circuit 200 is turned on or not.

For example, in a data writing phase, the data writing sub-circuit 200 may be turned on in response to the scanning signal, so that the data signal, which is lower than the data reference voltage may be written to the first terminal 110 (the second node N2) of the driving sub-circuit 100, and the data signal may be stored in the compensation sub-circuit 300 to generate the driving current, which is configured to drive the light-emitting element 500 to emit light according to the data signal, for example, in the light-emitting phase.

For example, the compensation sub-circuit 300 is connected to the control terminal 130 (the first node N1) of the driving sub-circuit, the second terminal 120 (the third node N3) of the driving sub-circuit, and the first voltage terminal OVDD, and is configured to store the data signal written by the data writing sub-circuit 200, and to compensate the driving sub-circuit 100 in response to the scanning signal. For example, the compensation sub-circuit 300 may be connected to the scanning signal line (the scanning signal terminal GAT_N), the first voltage terminal OVDD, the first node N1, and the third node N3. For example, the scanning signal provided by the scanning signal terminal GAT_N is applied to the compensation sub-circuit 300 to control whether the compensation sub-circuit 300 is turned on or not.

For example, in a case where the compensation sub-circuit 300 includes a capacitor, for example, in a data writing and compensation phase, the compensation sub-circuit 300 is turned on in response to the scanning signal, so that the data signal written by the data writing sub-circuit 200 may be stored in the capacitor. For example, meanwhile, in the data writing and compensation phase, the compensation sub-circuit 300 can electrically connect the control terminal 130 and the second terminal 120 of the driving sub-circuit 100, so that the relevant information of a threshold voltage of the driving sub-circuit 100 can be stored in the capacitor accordingly, and for example, in the light-emitting phase, the driving sub-circuit 100 is controlled by the data signal and the threshold voltage, which are stored, thus compensating the output of the driving sub-circuit 100.

For example, the first light-emitting control sub-circuit 400 is connected to the second terminal 120 (the third node N3) of the driving sub-circuit 100 and the first voltage terminal OVDD, and is configured to apply the first voltage of the first voltage terminal OVDD to the second terminal 120 of the driving sub-circuit 100 in response to a light-emitting control signal. For example, as shown in FIG. 3, the first light-emitting control sub-circuit 400 is connected to a light-emitting control terminal EM, the first voltage terminal OVDD, and the third node N3. For example, the light-emitting control terminal EM may be connected to a light-emitting control line that provides the light-emitting control signal, or connected to a control circuit that provides the light-emitting control signal.

For example, the second light-emitting control sub-circuit 600 is connected to the light-emitting control terminal EM, a first terminal 510 of the light-emitting element 500, and the first terminal 110 of the driving sub-circuit 100, and is configured to apply the driving current to the light-emitting element 500 in response to the light-emitting control signal.

For example, in the light-emitting phase, the first light-emitting control sub-circuit 400 and the second light-emitting control sub-circuit 600 are turned on in response to the light-emitting control signal provided by the light-emitting control terminal EM, so that the first voltage OVDD can be applied to the second terminal 120 of the driving sub-circuit 100. In a case where the driving sub-circuit 100 is turned on, the driving sub-circuit 100 can apply the first voltage OVDD to the light-emitting element 500, by the second light-emitting control sub-circuit 600, to provide a driving voltage, thereby driving the light-emitting element to emit light. In a non-light-emitting phase, the first light-emitting control sub-circuit 400 and the second light-emitting control sub-circuit 600 are turned off in response to the light-emitting control signal, thereby preventing the current from flowing through the light-emitting element 500 to drive the light-emitting element 500 to emit light, and improving a contrast ratio of the display device.

For example, the light-emitting element 500 includes the first terminal 510 and a second terminal 520, the first terminal 510 of the light-emitting element 500 is configured to receive the driving current from the first terminal 120 of the driving sub-circuit 100 by the second light-emitting control sub-circuit 600, and the second terminal 520 of the light-emitting element 500 is connected to a fourth voltage terminal VSS.

FIG. 4 is a schematic block diagram of another pixel circuit provided by some embodiments of the present disclosure. For example, on the basis of the embodiment as shown in FIG. 3, the pixel circuit 10 of this embodiment may further include a reset sub-circuit 700.

For example, the reset sub-circuit 700 is connected to a reset voltage terminal Vinit, the control terminal 130 (the first node N1) of the driving sub-circuit 100, and the first terminal 510 (a forth node N4) of the light-emitting element 500, and is configured to apply a reset voltage (for example, a low voltage) to the control terminal 130 of the driving sub-circuit 100 and the first terminal 510 of the light-emitting element 500 in response to a reset signal. For example, as shown in FIG. 4, the reset sub-circuit 700 is connected to the first node N1, the fourth node N4, the reset voltage terminal Vinit, the first terminal 510 of the light-emitting element 500, and a reset control terminal Rst (a reset control line), respectively. For example, in an initialization phase, the reset sub-circuit 700 may be turned on in response to the reset signal, so that the reset voltage may be applied to the first node N1 and the fourth node N4, and the driving sub-circuit 100, the compensation sub-circuit 300, and the light-emitting element 500 may be reset to eliminate the influence of the light-emitting phase in previous.

It should be noted that, in some embodiments of the present disclosure, the first voltage terminal OVDD, for example, maintains to be inputted a DC high-level signal, and the DC high-level signal is referred to as the first voltage. The fourth voltage terminal VSS, for example, maintains to be inputted a DC low-level signal, and the DC low-level signal is referred to as the fourth voltage, which is lower than the first voltage. The embodiments mentioned above may be applied to the following embodiments, and will not be described again.

It should be noted that, in the description of the embodiments of the present disclosure, the first node N1, the second node N2, the third node N3, and the fourth node N4 do not represent actual components, but rather represent junction points of related circuit connections in the circuit diagram.

It should be noted that, in the description of the embodiments of the present disclosure, the symbol Vdata may represent both the data signal terminal and A level of the data signal. Similarly, the symbol Vinit may represent both the reset voltage terminal and the reset voltage, the symbol OVDD may represent both the first voltage terminal and the first voltage, and the symbol VSS can represent both the fourth voltage terminal and the fourth voltage. The embodiments mentioned above may be applied to the following embodiments, and will not be described again.

FIG. 5 is a circuit diagram of a specific implementation embodiment of the pixel as shown in FIG. 4. As shown in FIG. 5, the pixel circuit 10 includes a first transistor T1, a second transistor T2, a third transistor T3, a fourth transistor T4, a fifth transistor T5, a sixth transistor T6, a seventh transistor T7, a capacitor C, and a light-emitting element L1. For example, the first transistor T1 is used as a driving transistor, and the second transistor T2 to the seventh transistor T7 are used as switching transistors. For example, the light-emitting element L1 may be various types of OLED, such as a top emission, a bottom emission, a double-sided emission, etc., and may emit red light, green light, blue light, white light, etc. The embodiments of the present disclosure are not limited to this case. The following description are illustrated by taking a case that the first transistor T1 to the seventh transistor T7 are P-type transistors as an example. That is, a gate electrode of each of the P-type transistors is turned on in a case where the gate electrode is connected to a low level, and is turned off in a case where the gate electrode is connected to a high level. The embodiments mentioned above may be applied to the following embodiments, and will not be described again.

For example, as shown in FIG. 5, in more detail, the driving sub-circuit 100 may be implemented as the first transistor T1. A gate electrode of the first transistor T1 is used as the control terminal 130 of the driving sub-circuit 100, and is connected to the first node N1. A first electrode of the first transistor T1 is used as the first terminal 110 of the driving sub-circuit 100, and is connected to the second node N2. A second electrode of the first transistor T1 is used as the second terminal 120 of the driving sub-circuit 100, and is connected to the third node N3.

The data writing sub-circuit 200 may be implemented as the second transistor T2. A gate electrode of the second transistor T2 is connected to the scanning line (the scanning signal terminal GAT_N) to receive the scanning signal, a first electrode of the second transistor T2 is connected to the data line (the data signal terminal Vdata) to receive the data signal, and a second electrode of the second transistor T2 is connected to the first terminal 110 (the second node N2) of the driving sub-circuit 100.

The compensation sub-circuit 300 may be implemented as the third transistor T3 and the capacitor C. A gate electrode of the third transistor T3 is configured to be connected to the scanning line (the scanning signal terminal GAT_N) to receive the scanning signal, a first electrode of the third transistor T3 is connected to the control terminal 130 (the first node N1) of the driving sub-circuit 100, and a second electrode of the third transistor T3 is connected to the second terminal 120 (the third node N3) of the driving sub-circuit 100. A first electrode of the capacitor C is connected to the control terminal 130 of the driving sub-circuit 100, and a second electrode of the capacitor C is connected to the first voltage terminal OVDD.

The first light-emitting control sub-circuit 400 may be implemented as the fourth transistor T4. A gate electrode of the fourth transistor T4 is connected to the light-emitting control line (the light-emitting control terminal EM) to receive the light-emitting control signal, a first electrode of the fourth transistor T4 is connected to the first voltage terminal OVDD to receive the first voltage of the first reference voltage, and a second electrode of the fourth transistor T4 is connected to the second terminal 120 (the third node N3) of the driving sub-circuit 100.

The second light-emitting control sub-circuit 600 may be implemented as a fifth transistor T5. A gate electrode of the fifth transistor T5 is connected to the light-emitting control line (the light-emitting control terminal EM) to receive the light-emitting control signal, a first electrode of the fifth transistor T5 is connected to the first terminal 110 (the second node N2) of the driving sub-circuit 100, and a second electrode of the fifth transistor T5 is connected to the first terminal 510 (the fourth node N4) of the light-emitting element L1.

A connection of the first terminal 510 (in the embodiment, an anode electrode) of the light-emitting element L1 and the fourth node N4 is configured to receive the driving current from the first terminal 110 of the driving sub-circuit 100 by the second light-emitting control sub-circuit 600. The second terminal 520 (in the present embodiment, a cathode) of the light-emitting element L1 is configured to be connected to the fourth voltage terminal VSS to receive the fourth voltage. For example, the fourth voltage terminal may be grounded, that is, the fourth voltage VSS may be zero.

The reset sub-circuit 400 may be implemented as the sixth transistor T6 and the seventh transistor T7. A gate electrode of the sixth transistor T6 is configured to be connected to the reset control terminal Rst to receive the reset signal, a first electrode of the sixth transistor T6 is connected to the reset voltage terminal Vinit to receive the reset voltage, and a second electrode of the sixth transistor T6 is configured to be connected to the first terminal 510 of the light-emitting element L1. A gate electrode of the seventh transistor T7 is configured to be connected to the reset control terminal Rst to receive the reset signal, a first electrode of the seventh transistor T7 is connected to the reset voltage terminal Vinit to receive the reset voltage, and a second electrode of the seventh transistor T7 is connected to the first node N1.

It should be noted that, the transistors adopted in the embodiments of the present disclosure may be thin film transistors or field effect transistors or other switching devices with the same characteristics, and in the embodiments of the present disclosure, all of the embodiments are illustrated by taking a case that transistors are thin film transistors as examples. A source electrode and a drain electrode of the transistor adopted in the embodiments may be symmetrical in structure, so that the source electrode and the drain electrode may be structurally indistinguishable. In the embodiments of the present disclosure, In order to distinguish the two electrodes, except the gate electrode, of the transistor, one electrode is directly described as the first electrode, and another electrode is described as the second electrode.

Figure 6:
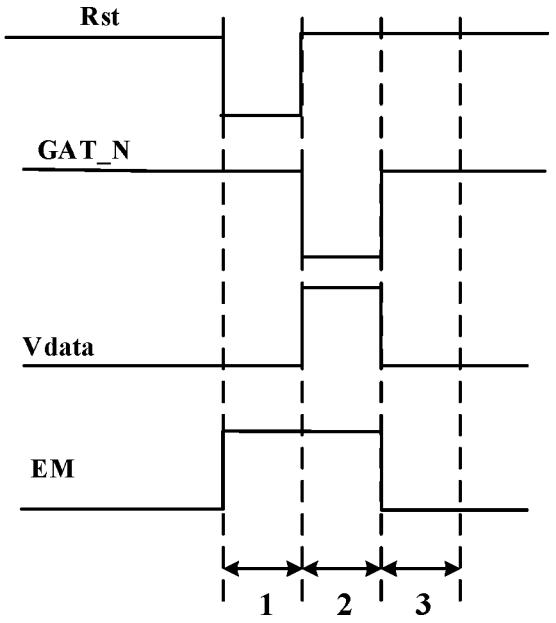
FIG. 6 is a timing diagram of a driving method of a pixel circuit provided by some embodiments of the present disclosure.
Figure 7A:
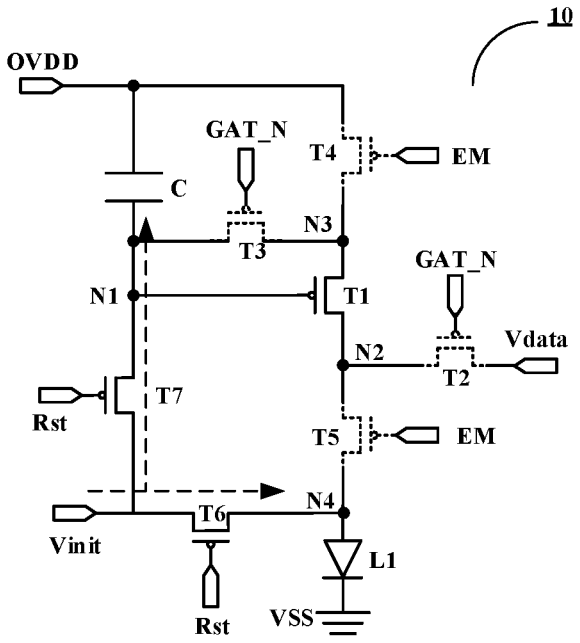
FIG. 7A-FIG. 7C are circuit schematic diagrams of the pixel circuit as shown in FIG. 5 corresponding to three phases in FIG. 6, respectively.
Figure 7B:
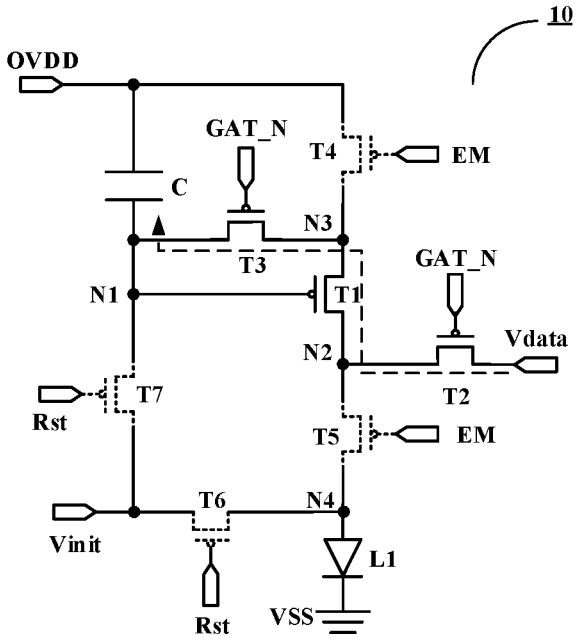
Figure 7C:
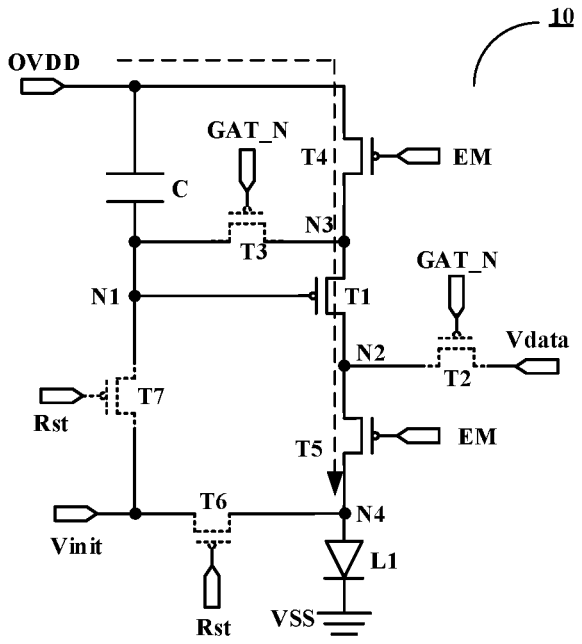

FIG. 6 is a timing diagram of a driving method of a pixel circuit provided by some embodiments of the present disclosure. FIG. 7A-FIG. 7C are circuit schematic diagrams of the pixel circuit as shown in FIG. 5 corresponding to three phases in FIG. 6, respectively. The operation principle of the pixel circuit 10 as shown in FIG. 5 will be described below with reference to a signal timing diagram as shown in FIG. 6.

As shown in FIG. 6, a display process of each frame of an image includes three phases, which are an initialization phase 1, a data writing and compensation phase 2 and a light-emitting phase 3, respectively. A timing waveform of each signal in each phase is shown in the FIG. 6.

It should be noted that, FIG. 7A is a schematic diagram of the pixel circuit as shown in FIG. 5 in the initialization phase 1, FIG. 7B is a schematic diagram of the pixel circuit as shown in FIG. 5 in the data writing and compensation phase 2, and FIG. 7C is a schematic diagram of the pixel circuit as shown in FIG. 5 in the light emitting phase 3. In addition, the transistors identified by dashed lines in FIG. 7A to FIG. 7C all indicate that the transistors are in a turn-off state in the corresponding phases, and dashed lines with arrows in FIG. 7A to FIG. 7C indicate a current direction of the pixel circuit in the corresponding phases.

In the initialization phase 1, the reset signal is inputted to turn on the reset sub-circuit 700, and the reset voltage is applied to the first node N1 (the control terminal 130 of the driving sub-circuit 100) and the fourth node N4 (the first terminal 510 of the light-emitting element 500). For example, as shown in FIG. 6, the reset signal may be the scanning signal of a pixel circuit in a previous row, that is, the reset signal may further be the scanning signal outputted by the gate driving circuit. This case may be applied to the following embodiments, and will not be described again.

As shown in FIG. 6 and FIG. 7A, in the initialization phase 1, because the sixth transistor T6 and the seventh transistor T7 are turned on by the reset signal with a low level, the second transistor T2 and the third transistor T3 are turned off by the scanning signal with a high level, and the fourth transistor T4 and the fifth transistor T5 are turned off by the light-emitting control signal with a high level.

As shown in FIG. 7A, in the initialization phase 1, a reset path is formed (as shown by the dashed lines with arrows in FIG. 7A). Therefore, in this phase, a capacitor C and the gate electrode of the first transistor T1 are discharged by the seventh transistor T7, and the light-emitting element L1 is discharged by the sixth transistor T6, thereby resetting the first node N1 and the light-emitting element L1 (that is, the fourth node N4). Therefore, after the initialization phase 1, a potential of the first node N1 is the reset voltage Vinit (a low-level signal, for example, may be grounded or other low-level signals), so that, in this phase, the data signal and the threshold voltage written into the capacitor C in the display process of a previous frame can be erased, while a potential of the fourth node N4 is the reset voltage Vinit, a cross voltage of the light-emitting element L1 in this phase is less than or equal to zero, and a short-term afterimage problem, that may occur due to the hysteresis effect of the display device adopting the pixel circuit 10, may be improved.

In the data writing and compensation phase 2, the scanning signal and the data signal are inputted to turn on the data writing sub-circuit 200, the driving sub-circuit 100, and the compensation sub-circuit 300. The data writing sub-circuit 200 writes the data signal to the driving sub-circuit 100, the compensation sub-circuit 300 stores the data signal, and the compensation sub-circuit 300 compensates the driving sub-circuit 100.

As shown in FIG. 6 and FIG. 7B, in the data writing and compensation phase 2, the second transistor T2 and the third transistor T3 are turned on by the scanning signal with a low level, and the sixth transistor T6 and the seventh transistor T7 are turned off by the reset signal with a high level. Meanwhile, the fourth transistor T4 and the fifth transistor T5 are turned off by the light-emitting control signal with a high level.

As shown in FIG. 7B, in the data writing and compensation phase 2, a data writing and compensation path is formed (as shown by the dashed line with the arrow in FIG. 7B), after the data signal passes through the second transistor T2, the first transistor T1 and the third transistor T3, the first node N1 is charged (that is, the capacitor C is charged), that is, the potential of the first node N1 is increased. It is easy to be understood that the potential of the second node N2 is maintained at Vdata, and under this case, according to characteristics of the first transistor T1, in a case where the potential of the first node N1 is increased to Vdata+Vth, the first transistor T1 is turned off and the charging process ends. It should be noted that Vdata represents a voltage value of the data signal, and Vth represents the threshold voltage of the first transistor. In the present embodiment, the first transistor T1 is described by taking a case that the first transistor T1 is a P-type transistor as an example, therefore, the threshold voltage Vth may be a negative value in the embodiment.

After the data writing and compensation phase 2, the potentials of the first node N1 and the third node N3 are both Vdata+Vth, that is, the voltage information, which including the data signal and the threshold voltage Vth, is stored in the capacitor C, which is used to provide a gray scale display data, and to compensate the threshold voltage of the first transistor T1 itself in the light-emitting phase.

In the light-emitting phase 3, the light-emitting control signal is inputted to turn on the first light-emitting control sub-circuit 400, the second light-emitting control sub-circuit 600, and the driving sub-circuit 100. The first voltage provided by the first voltage terminal OVDD applies the driving current to the light-emitting element L1 by the first light-emitting control sub-circuit 400, the driving sub-circuit 100, and the second light-emitting control sub-circuit 600 to emit the light-emitting element L1 light.

As shown in FIG. 6 and FIG. 7C, in the light-emitting phase 3, the fourth transistor T4 and the fifth transistor T5 are turned on by the light-emitting control signal with a low level. Meanwhile, the second transistor T2 and the third transistor T3 are turned off by the scanning signal with a high level, and the sixth transistor T6 and the seventh transistor T7 are turned off by the reset signal with a high level. Meanwhile, the potential of the first node N1 is Vdata+Vth and the potential of the third node N3 are OVDD, therefore, the first transistor T1 further remains in a turn-on state in this phase.

As shown in FIG. 7C, in the light-emitting phase 3, a drive light-emitting path is formed (as shown by the dashed line with the arrow in FIG. 7C). The light-emitting element L1 may emit light under the driving of the driving current flowing through the first transistor T1.

Specifically, a value of the driving current $I_{L1}$ flowing through the light-emitting element L1 may be obtained according to the following formula:

$$\begin{aligned} I_{L1} &= (K/2)*(V_{GS} - V\text{th})^2 \\ &= (K/2)*[(V\text{data} + V\text{th} - VDD) - V\text{th}]^2 \\ &= (K/2)*(V\text{data} - VDD)^2 \end{aligned}$$

where $$K = W^* C_{OX}^* * U / L.$$

In the above formula, Vth represents the threshold voltage of the first transistor T1, $V_{GS}$ represents a voltage between the gate electrode and the source electrode (in the embodiment, the first electrode) of the first transistor T1, and K is a constant value related to the driving transistor itself.

It can be obtained from the above calculation formula of $I_{L1}$ that the driving current $I_{L1}$ flowing through the light-emitting element L1 is no longer related to the threshold voltage Vth of the first transistor T1, but only to the data signal Vdata and the first voltage OVDD. More specifically, the driving current $I_{L1}$ is related to the difference between the data signal Vdata and the first voltage OVDD. Therefore, in a case where the pixel circuit is compensated, the data signal Vdata and the first voltage OVDD are simultaneously reduced, so that the driving current $I_{L1}$ flowing through the light-emitting element L1 can be ensured to be unchanged, and the normal display of the display panel can be ensured. Therefore, by reducing the first voltage OVDD (for example, smaller than the first reference voltage), and reducing the input voltage supplied to the source driving circuit (thereby reducing the data signal generated by the source driving circuit), the load of the driving circuit and the power consumption of the display device may be reduced.

Similarly, driving currents $I_{L1}$ flowing through light-emitting elements L1 of different pixel circuits may be different. If other parameters are included in the above-mentioned calculation formula of the driving current $I_{L1}$, the magnitude of the other parameters may further be correspondingly reduced to reduce the power consumption of the display device. Therefore, the display driving method provided by some embodiments of the present disclosure is not limited to reducing the magnitude of the first voltage and the magnitude of the data signal which are mentioned above, but may further include adjusting the values of other parameters, depending on the actual conditions, and the embodiments of the present disclosure are not limited to this case.

For the step S120, for example, in some embodiments, the second voltage, which is lower than the second reference voltage, may be supplied to the second voltage terminal of the source driving circuit by the boosting circuit (for example, a charge pump) in the power management circuit. For example, in the embodiments of the present disclosure, a boosting ratio of the boosting circuit is lower than a reference ratio. For example, the reference ratio may be 2 to 3, depending on the actual conditions, and the embodiments of the present disclosure are not limited to this case.

For example, the boosting ratio, which is lower than the reference ratio, is 1 to 1.5, so that after the input voltage VCI of the power management circuit passing through the boosting circuit, the output voltage is between VCI and 1.5*VCI. For example, in an embodiment, the second voltage is equal to the input voltage of the power management circuit, and the boosting ratio of the boosting circuit can be set to one, that is, the boosting circuit can output the second voltage, which is lower than the second reference voltage, without boosting, therefore, by reducing the boosting ratio, the load of the boosting circuit can be reduced, thereby reducing the power consumption of the display device.

For example, in another embodiment, a voltage received by the second voltage terminal of the source driving circuit is switched to the input voltage, which serves as the second voltage, provided by an input voltage terminal of the power management circuit. For example, in an embodiment, by connecting the second voltage terminal of the source driving circuit with the input voltage terminal of the power management circuit, the voltage received by the second voltage terminal may be switched to the input voltage provided by the input voltage terminal.

For example, a switching circuit may be provided, and the voltage received by the second voltage terminal of the source driving circuit is switched to the second voltage by the switching circuit. For example, the switching circuit can be implemented by a circuit structure in the related art, and will not be described here again.

The display driving method provided by some embodiments of the present disclosure can reduce the first voltage OVDD of the pixel circuit and the data signal required by the pixel circuit, for example, so that the level of the data signal required by the pixel circuit is reduced to the input voltage VC1 of the power management circuit and below the input voltage VCI (that is, the second voltage) of the power management circuit. The input voltage of the source driving circuit is switched to the second voltage, or the boosting ratio of the boosting circuit is reduced, thereby reducing the driving load of the display device and improving the power supply or drive efficiency of the power management circuit in the display device, for example, so that the power supply or the drive efficiency can be increased by 10-20%, the display quality of the display device can be improved, and the market competitiveness of the display device can be improved.

Figure 2:
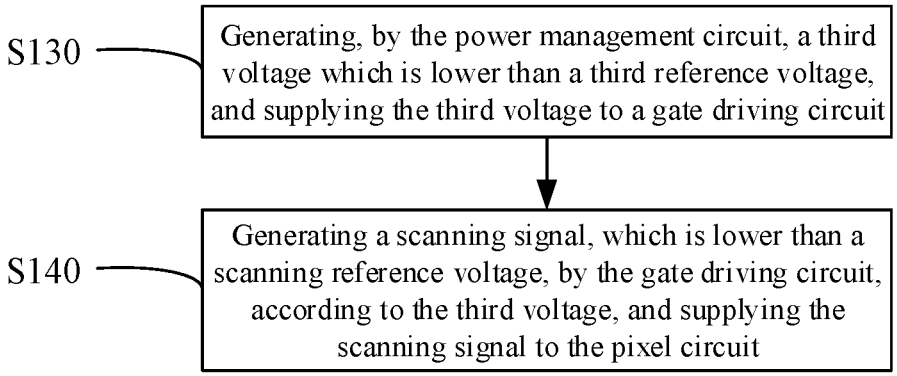
FIG. 2 is a flowchart diagram of another display driving method provided by some embodiments of the present disclosure.

FIG. 2 is a flowchart diagram of another display driving method provided by some embodiments of the present disclosure. As shown in FIG. 2, The display driving method provided by some embodiments of the present disclosure can further reduce a power supply of the gate driving circuit (for example, a DC high level VGH and a DC low level VGL) to reduce the scanning signal outputted by the gate driving circuit, thereby further reducing the power consumption of the display device. As shown in FIG. 2, based on the embodiment as shown in FIG. 1, the display driving method further includes step S130 and step S140. Next, the display driving method will be described with reference to FIG. 2.

Step S130: generating, by the power management circuit, a third voltage which is lower than a third reference voltage, and supplying the third voltage to a gate driving circuit.

Step S140: generating a scanning signal, which is lower than a scanning reference voltage, by the gate driving circuit, according to the third voltage, and supplying the scanning signal to the pixel circuit.

For the step S130, for example, the third voltage may include a DC high level VGH or a DC low level VGL, which are supplied to the gate driving circuit. For example, in a case where the data signal Vdata is lower than the data reference voltage, the level of the scanning signal required by the pixel circuit may further be lowered, for example, the level of the scanning signal is lower than the scanning reference voltage. For example, the circuit structure and the working principle of the gate driving circuit can be implemented by techniques in the related art, and will not be described here again.

For the step S140, according to the working principle of the gate driving circuit, the gate driving circuit may generate the scanning signal, which is lower than the scanning reference voltage, based on the third voltage, which is lower than the third reference voltage. For example, the scanning signal (the scanning signal GAT_N of an nth row pixel circuit as shown in FIG. 5) is supplied to the data writing sub-circuit 200 and the compensation sub-circuit 300 of the pixel circuit as shown in FIG. 5 by the gate line.

For example, the power consumption of the display panel can be expressed as:

$$P \propto F*C*U$$

In the above formula, P represents the power consumption of the display panel, F represents a scanning frequency of the display panel, C represents a parasitic capacitance of the display panel, and U represents the voltage (for example, the third voltage of the gate driving circuit).

According to the above formula, in a case where the value of the voltage U decreases, the power consumption of the gate driving circuit and the pixel circuit decreases, so that the power consumption of the display panel can be reduced under the condition of ensuring the display quality of the display panel by the display driving method.

It should be noted that, in some embodiments of the present disclosure, the steps of the display driving method may include more or less operations, which may be performed sequentially or in parallel. Although the steps of the display driving method described above includes a plurality of operations occurring in a specific order, it should be clearly understood that the order of the plurality of operations is not limited. The display driving method described above may be executed once or multiple times according to predetermined conditions.

Figure 8:
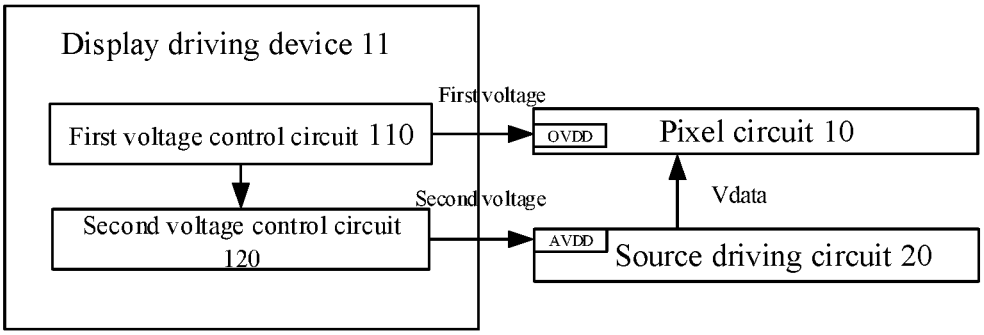
FIG. 8 is a schematic block diagram of a display driving device provided by some embodiments of the present disclosure.

FIG. 8 is a schematic block diagram of a display driving device provided by some embodiments of the present disclosure. For example, in the embodiment as shown in FIG. 8, the display driving device 11 includes a first voltage control circuit 110 and a second voltage control circuit 120. For example, these circuits may be implemented by a hardware (for example, a circuit) module, etc., for example, the hardware module may include an operational amplifier, etc.

For example, the first voltage control circuit 110 is configured to provide a first voltage, which is lower than a first reference voltage, to a first voltage terminal OVDD of the pixel circuit 10 to drive the pixel circuit 10. For example, a voltage reduction amplitude of the first voltage relative to the first reference voltage is a first amplitude. For example, the pixel circuit may adopt the circuit structure as shown in FIG. 5, and of course, other structures of the related art may further be adopted, and the embodiments of the present disclosure are not limited thereto. For example, the first voltage control circuit 110 may implement the step S110, and the specific implementation method thereof may refer to the relevant description of the step S110, and will not be described here again.

The second voltage control circuit 120 is configured to provide a second voltage, which is lower than a second reference voltage, to a second voltage terminal AVDD of a source driving circuit 20 to control the source driving circuit 20 to generate a data signal Vdata, which is lower than a data reference voltage, and to provide the data signal to the pixel circuit. For example, a voltage reduction amplitude of the data signal Vdata relative to the data reference voltage is the first amplitude. For example, the source driving circuit may adopt a structure in the related art, and the embodiments of the present disclosure are not limited thereto. For example, the second voltage control circuit 120 may implement the step S120, and the specific implementation method thereof may refer to the relevant description of the step S120, and will not be described here again.

It should be noted that, in the display driving device 11 provided by some embodiments of the present disclosure, more or fewer circuits or units may be included, and the connection relationship between the circuits or units is not limited, and may be determined according to actual requirements. The specific configuration of each circuit is not limited, and may be composed of analog devices, digital chips, or other suitable methods according to circuit principles.

Figure 9:
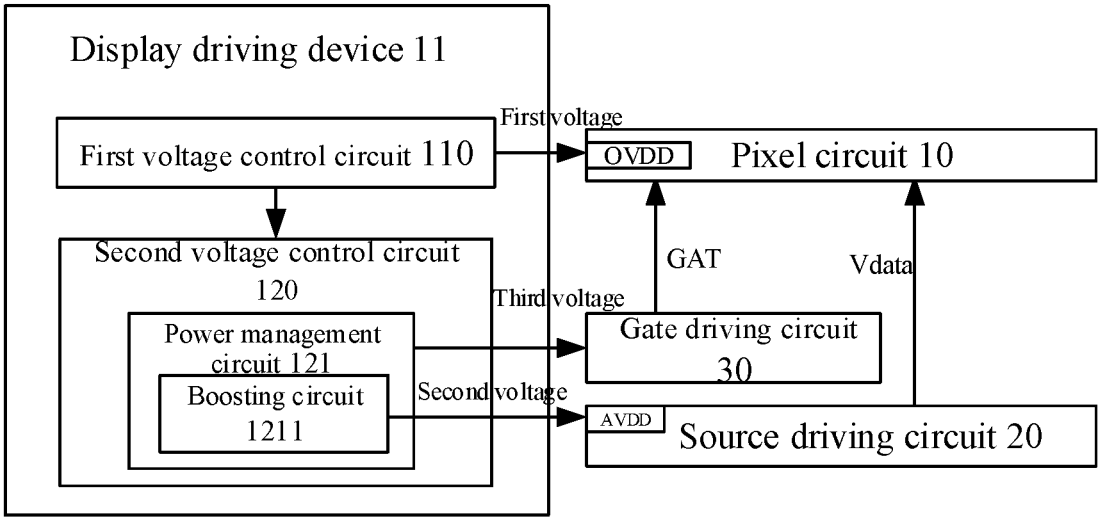
FIG. 9 is a schematic block diagram of another display driving device provided by some embodiments of the present disclosure.

FIG. 9, is a schematic block diagram of another display driving device provided by some embodiments of the present disclosure. For example, in the embodiment as shown in FIG. 9, the second voltage control circuit 120 includes a power management circuit 121.

For example, the power management circuit 121 includes a boosting circuit 1211, and is configured to generate the second voltage, and to supply the second voltage to the source driving circuit 20. For example a boosting ratio of the boosting circuit 1211 is lower than a reference ratio. For example, the boosting ratio can be set to 1 to 1.5, and the reference ratio can be 2 to 3, etc., depending on the actual conditions, the embodiments of the present disclosure are not limited to this case.

For example, in an embodiment, the second voltage is equal to the input voltage VCI of the power management circuit 121, and the boosting circuit 1211 can output the second voltage, which is lower than the second reference voltage, without boosting (that is, the boosting ratio is set to 1). Therefore, by reducing the boosting ratio, the load, which is used to drive the boosting circuit, can be reduced, thereby reducing the power consumption of the display device.

Figure 10:
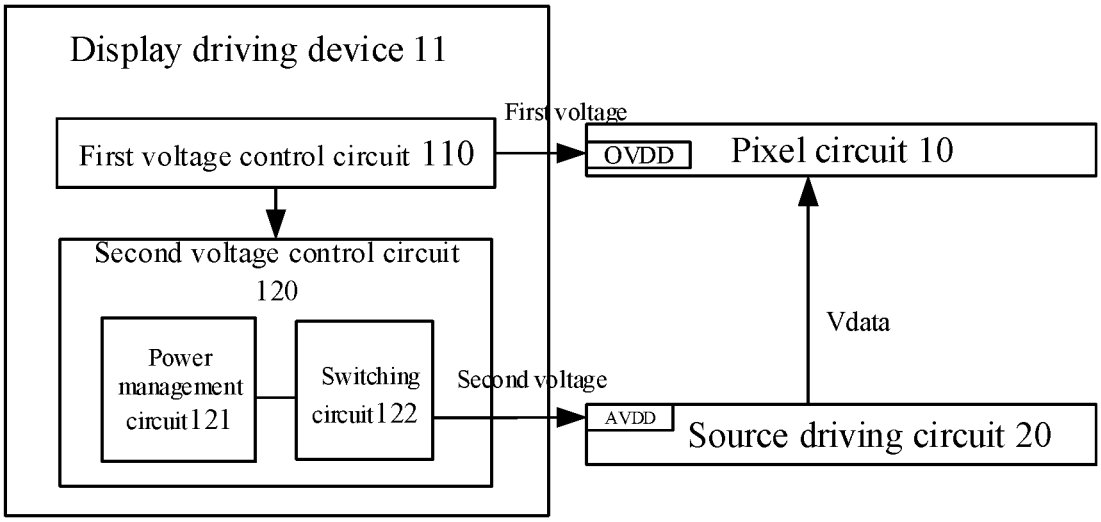
FIG. 10 is a schematic block diagram of still another display driving device provided by some embodiments of the present disclosure.

FIG. 10 is a schematic block diagram of still another display driving device provided by some embodiments of the present disclosure. For example, in the embodiment as shown in FIG. 10, the second voltage control circuit 120 further includes a switching circuit 122.

For example, in some embodiment, the switching circuit 122 is configured to switch a voltage received by the second voltage terminal AVDD of the source driving circuit 200 to the input voltage VCI, which serves as the second voltage, provided by the input voltage terminal (not shown in the figure) of the power management circuit 121. For example, in an example, the second voltage terminal AVDD of the source driving circuit 20 may be connected to the input voltage terminal of the power management circuit 121 by the switching circuit 122 to switch the second voltage received by the second voltage terminal to the input voltage provided by the input voltage terminal.

It should be noted that the switching circuit can be implemented by circuit structures in the related art, and will not be described in detail here again.

For example, based on the embodiment as shown in FIG. 9, the power management circuit 121 is further configured to generate a third voltage which is lower than a third reference voltage to a gate driving circuit 30.

For example, the gate driving circuit 30 is configured to generate a scanning signal GAT, which is lower than a scanning reference voltage, according to the third voltage, and to supply the scanning signal GAT to the pixel circuit 10. For example, the power supply of the gate driving circuit 30 (for example, the DC high level VGH and the DC low level VGL) is reduced to reduce the scanning signal GAT output by the gate driving circuit 30, thereby further reducing the power consumption of the display device. For example, the scanning signal (the scanning signal GAT_N of an Nth row of pixel circuit as shown in FIG. 5) is supplied to the data writing sub-circuit 200 and the compensation sub-circuit 300 of the pixel circuit 10 as shown in FIG. 5 by the gate line.

For example, the gate driving circuit may adopt a circuit structure in the related art, and the circuit structure and the working principle of the circuit structure are not described here again.

It should be noted that, for the sake of clarity and conciseness, some embodiments of the present disclosure do not provide all components of the display driving device 11. In order to realize the necessary functions of the display driving device 11, those skilled in the art may provide and set other components, which are not shown, according to specific requirements, and the embodiments of the present disclosure are not limited to this case.

The technical effects of the display driving device 11 in different embodiments may refer to the technical effects of the display driving method provided in the embodiments of the present disclosure, which will not be repeated here again.

Some embodiments of the present disclosure further provide a display device, and the display device can reduce display power consumption. FIG. 11 is a schematic diagram of a display device provided by some embodiments of the present disclosure. As shown in FIG. 11, the display device 1 includes a display driving device 11, a display panel 210, pixel circuits 10 arranged in an array, a source driving circuit 20, and a gate driving circuit 30. For example, the display driving device 11 may adopt the display driving device provided in any one of embodiments of the present disclosure, for example, the display driving device 11 as shown in FIG. 9 may be adopted by the display driving device 11.

For example, the display driving device 11 is connected to the source driving circuit 20, the gate driving circuit 30, and the pixel circuit 10 in the pixel array in the display panel 210 to provide the first voltage, which is lower than the first reference voltage, to the pixel circuit 10, the second voltage, which is lower than the second reference voltage, to the source driving circuit 20, and the third voltage, which is lower than the third reference voltage to the gate driving circuit 30, respectively, so that the data signal generated by the source driving circuit 20, which is lower than the data reference voltage, is transmitted to each column of pixel circuit 10 by a data line DL, and the scanning signal generated by the gate driving circuit 30, which is lower than the scanning reference voltage, is transmitted to each row of pixel circuit 10 line by line by a gate line GL. Therefore, the display device can realize low power consumption display.

For example, the gate driving circuit 30 may be a GOA (Gate Drive on circuit) directly manufactured on the display panel 210 or implemented as a gate driving chip, and mounted on the display panel 210 in a binding manner. The data driving circuit 20 may be directly manufactured on the display panel 210, for example, or implemented as a data driving chip, and mounted on the display panel 210 in a binding manner.

The technical effects of the display device 1 provided by some embodiments of the present disclosure may refer to the corresponding descriptions of the display driving method in the above-mentioned embodiments, which will not be repeated here again.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined.

What are described above is related to the illustrative embodiments of the disclosure only and not limitative to the scope of the disclosure; the scopes of the disclosure are defined by the accompanying claims.

What is claimed is:

1. A display driving method, comprising:

providing a first voltage, which is lower than a first reference voltage, to a first voltage terminal of a pixel circuit to drive the pixel circuit, wherein a voltage reduction amplitude of the first voltage relative to the first reference voltage is a first amplitude; and providing a second voltage, which is lower than a second reference voltage, to a second voltage terminal of a source driving circuit to control the source driving circuit to generate a data signal which is lower than a data reference voltage, and to provide the data signal to the pixel circuit, wherein a voltage reduction amplitude of the data signal relative to the data reference voltage is the first amplitude.

2. The display driving method according to claim 1, wherein providing the second voltage, which is lower than the second reference voltage, to the second voltage terminal of the source driving circuit, comprises:

generating the second voltage by a boosting circuit of a power management circuit, and supplying the second voltage to the source driving circuit, wherein a boosting ratio of the boosting circuit is lower than a reference ratio.

3. The display driving method according to claim 2, wherein the boosting ratio is 1 to 1.5.

4. The display driving method according to claim 3, wherein the second voltage is equal to an input voltage of the power management circuit.

5. The display driving method according to claim 2, wherein the second voltage is equal to an input voltage of the power management circuit.

6. The display driving method according to claim 2, further comprising:

generating, by the power management circuit, a third voltage which is lower than a third reference voltage, and supplying the third voltage to a gate driving circuit; and generating a scanning signal, which is lower than a scanning reference voltage, by the gate driving circuit, according to the third voltage, and supplying the scanning signal to the pixel circuit.

7. The display driving method according to claim 1, wherein providing the second voltage, which is lower than the second reference voltage, to the second voltage terminal of the source driving circuit, comprises:

switching a voltage received by the second voltage terminal of the source driving circuit to an input voltage, which serves as the second voltage, provided by an input voltage terminal of a power management circuit.

8. The display driving method according to claim 7, further comprising:

generating, by the power management circuit, a third voltage which is lower than a third reference voltage, and supplying the third voltage to a gate driving circuit; and generating a scanning signal, which is lower than a scanning reference voltage, by the gate driving circuit, according to the third voltage, and supplying the scanning signal to the pixel circuit.

9. The display driving method according to claim 8, wherein the pixel circuit comprises a driving sub-circuit, a data writing sub-circuit, a compensation sub-circuit, a first light-emitting control sub-circuit, a second light-emitting control sub-circuit, and a light-emitting element;

the driving sub-circuit comprises a control terminal, a first terminal, and a second terminal, and is configured to control a driving current, which flows through the first terminal and the second terminal and drives the light-emitting element to emit light;

the data writing sub-circuit is connected to the first terminal of the driving sub-circuit, and is configured to write the data signal which is lower than a data reference voltage to the first terminal of the driving sub-circuit in response to a scanning signal;

the compensation sub-circuit is connected to the control terminal of the driving sub-circuit, the second terminal of the driving sub-circuit, and the first voltage terminal, and is configured to store the data signal written by the data writing sub-circuit, and to compensate the driving sub-circuit in response to the scanning signal;

the first light-emitting control sub-circuit is connected to the second terminal of the driving sub-circuit and the first voltage terminal, and is configured to apply the first voltage, which is lower than a first reference voltage received by the first voltage terminal, to the second terminal of the driving sub-circuit in response to a light-emitting control signal;

a second light-emitting control sub-circuit is connected to the first terminal of the driving sub-circuit and a first terminal of the light-emitting element, and is configured to apply the driving current to the light-emitting element in response to the light-emitting control signal; and the light-emitting element comprises the first terminal and a second terminal, the first terminal of the light-emitting element is configured to receive the driving current, and the second terminal of the light-emitting element is connected to a fourth voltage terminal to receive a fourth voltage.

10. The display driving method according to claim 1, wherein the pixel circuit comprises a driving sub-circuit, a data writing sub-circuit, a compensation sub-circuit, a first light-emitting control sub-circuit, a second light-emitting control sub-circuit, and a light-emitting element;

the driving sub-circuit comprises a control terminal, a first terminal, and a second terminal, and is configured to control a driving current, which flows through the first terminal and the second terminal and drives the light-emitting element to emit light;

the data writing sub-circuit is connected to the first terminal of the driving sub-circuit, and is configured to write the data signal which is lower than a data reference voltage to the first terminal of the driving sub-circuit in response to a scanning signal;

the compensation sub-circuit is connected to the control terminal of the driving sub-circuit, the second terminal of the driving sub-circuit, and the first voltage terminal, and is configured to store the data signal written by the data writing sub-circuit, and to compensate the driving sub-circuit in response to the scanning signal;

the first light-emitting control sub-circuit is connected to the second terminal of the driving sub-circuit and the first voltage terminal, and is configured to apply the first voltage, which is lower than a first reference voltage received by the first voltage terminal, to the second terminal of the driving sub-circuit in response to a light-emitting control signal;

a second light-emitting control sub-circuit is connected to the first terminal of the driving sub-circuit and a first terminal of the light-emitting element, and is configured to apply the driving current to the light-emitting element in response to the light-emitting control signal; and the light-emitting element comprises the first terminal and a second terminal, the first terminal of the light-emitting element is configured to receive the driving current, and the second terminal of the light-emitting element is connected to a fourth voltage terminal to receive a fourth voltage.

11. The display driving method according to claim 10, wherein providing the first voltage, which is lower than the first reference voltage, to the first voltage terminal of the pixel circuit to drive the pixel circuit comprises a data writing and compensation phase and a light-emitting phase;

in the data writing and compensation phase, the scanning signal and the data signal is inputted to turn on the data writing sub-circuit, the driving sub-circuit, and the compensation sub-circuit, the data writing sub-circuit writes the data signal into the driving sub-circuit, the compensation sub-circuit stores the data signal, and the compensation sub-circuit compensates the driving sub-circuit; and in the light-emitting phase, the light-emitting control signal is inputted to turn on the first light-emitting control sub-circuit, the second light-emitting control sub-circuit, and the driving sub-circuit, the first light-emitting control sub-circuit applies the first voltage to the second terminal of the driving sub-circuit, and the second light-emitting control sub-circuit applies the driving current to the light-emitting element to drive the light-emitting element to emit light.

12. The display driving method according to claim 11, wherein the pixel circuit further comprises a reset sub-circuit; and the reset sub-circuit is connected to a reset voltage terminal, the control terminal of the driving sub-circuit, and the first terminal of the light-emitting element, and is configured to apply a reset voltage to the control terminal of the driving sub-circuit and the first terminal of the light-emitting element in response to a reset signal.

13. The display driving method according to claim 10, wherein the pixel circuit further comprises a reset sub-circuit; and the reset sub-circuit is connected to a reset voltage terminal, the control terminal of the driving sub-circuit, and the first terminal of the light-emitting element, and is configured to apply a reset voltage to the control terminal of the driving sub-circuit and the first terminal of the light-emitting element in response to a reset signal.

14. The display driving method according to claim 13, wherein providing the first voltage, which is lower than the first reference voltage, to the first voltage terminal of the pixel circuit to drive the pixel circuit further comprises an initialization phase; and in the initialization phase, the reset signal is inputted to turn on the reset sub-circuit, and the reset voltage is applied to the control terminal of the driving sub-circuit and the first terminal of the light-emitting element.

15. A display driving device, comprising:

a first voltage control circuit, configured to provide a first voltage, which is lower than a first reference voltage, to a first voltage terminal of a pixel circuit to drive the pixel circuit, wherein a voltage reduction amplitude of the first voltage relative to the first reference voltage is a first amplitude; and a second voltage control circuit, configured to provide a second voltage, which is lower than a second reference voltage, to a second voltage terminal of a source driving circuit to control the source driving circuit to generate a data signal which is lower than a data reference voltage, and to provide the data signal to the pixel circuit, wherein a voltage reduction amplitude of the data signal relative to the data reference voltage is the first amplitude.

16. The display driving device according to claim 15, wherein the second voltage control circuit comprises a power management circuit;

the power management circuit comprises a boosting circuit, and is configured to generate the second voltage by the boosting circuit, and to supply the second voltage to the source driving circuit; and a boosting ratio of the boosting circuit is lower than a reference ratio.

17. The display driving device according to claim 16, wherein the power management circuit is further configured to generate a third voltage which is lower than a third reference voltage, and supply the third voltage to a gate driving circuit; and the gate driving circuit is configured to generate a scanning signal, which is lower than a scanning reference voltage, according to the third voltage, and to supply the scanning signal to the pixel circuit.

18. The display driving device according to claim 15, wherein the second voltage control circuit comprises a switching circuit; and the switching circuit is configured to switch a voltage received by a second voltage terminal of the source driving circuit to an input voltage, which serves as the second voltage, provided by an input voltage terminal of a power management circuit.

19. The display driving device according to claim 18, wherein the power management circuit is further configured to generate a third voltage which is lower than a third reference voltage, and supply the third voltage to a gate driving circuit; and the gate driving circuit is configured to generate a scanning signal, which is lower than a scanning reference voltage, according to the third voltage, and to supply the scanning signal to the pixel circuit.

20. A display device, comprising the display driving device according to claim 15.

* * * * *